United States Patent [19]

Chen

[11] Patent Number: 4,655,134

[45] Date of Patent: Apr. 7, 1987

[54] METHOD OF BRANDING A SEMICONDUCTOR CHIP PACKAGE

[75] Inventor: Charles C. Chen, Houston, Tex.

[73] Assignee: Thomson Components-Mostek Corporation, Carrollton, Tex.

[21] Appl. No.: 756,461

[22] Filed: Jul. 18, 1985

[51] Int. Cl.[4] ..... B41F 17/00

[52] U.S. Cl. ..... 101/426; 101/35

[58] Field of Search ..... 101/35, 40, 44, 426

[56] References Cited

U.S. PATENT DOCUMENTS

| | | | |
|---|---|---|---|
| 2,924,169 | 2/1960 | Scott | 101/40 |
| 3,451,871 | 6/1969 | Bauer et al. | 156/244 |
| 3,502,022 | 3/1970 | Wood | 101/129 |
| 3,679,506 | 7/1972 | Burgess et al. | 156/209 |
| 4,059,471 | 11/1977 | Haigh | 156/244 |
| 4,073,992 | 2/1978 | Lerman et al. | 428/207 |
| 4,270,449 | 6/1981 | Ito et al. | 101/129 |
| 4,398,457 | 8/1983 | Takahashi et al. | 101/44 |

FOREIGN PATENT DOCUMENTS

| | | | |
|---|---|---|---|
| 28863 | 3/1981 | Japan | 101/35 |
| 33955 | 4/1981 | Japan | 101/35 |

*Primary Examiner*—Clifford D. Crowder

*Attorney, Agent, or Firm*—Roland Plottel

[57] ABSTRACT

A method for branding (labeling) a semiconductor chip package by warming the package prior to and subsequent to the branding resulting in a brand having greater clarity and permanency. A chip package is warmed to a temperature of about 95° F. (35° C.) to about 130° F. (55° C.) and an inked brand is applied to the warmed chip package. The branded chip package is maintained at a temperature of at least about 75° F. (24° C.) until the temperature is raised to a sufficient temperature to cure the branded chip package and then the branded chip package is cured.

10 Claims, 1 Drawing Figure

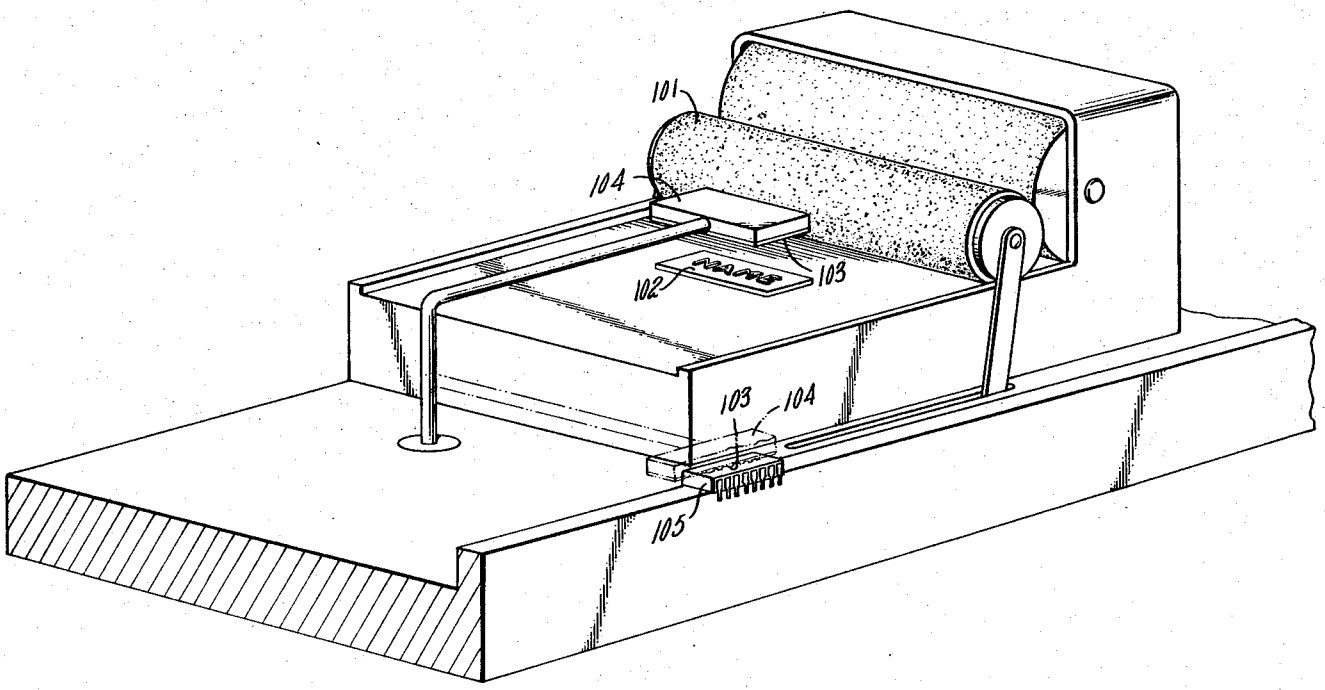
101
102
103
104
104
103
105

METHOD OF BRANDING A SEMICONDUCTOR CHIP PACKAGE

DESCRIPTION

1. Technical Field

This invention is directed to methods of printing and is particularly adapted to branding semiconductor chips.

2. Background Art

In the semiconductor industry, it is typically necessary to label (brand) the semiconductor chip packages. Typically these brands include such information as manufacturing data, product data and any applicable trademark or copyright. Thus, these brands provide intellectual property protection at the same time as they provide important information to the user. For example, if at some time it becomes necessary for a user to repair or exchange a semiconductor chip through malfunction or new advances in the art, it is important that the chip can be identified. Once a determination of where the malfunction occurred and the type of chip that malfunctioned are known, a fully functional chip can be exchanged for the defective device. Thus it is extremely important for a user to be able to read the brands on a semiconductor chip.

Present brands can suffer from at least two problems. First, the brand may not be clear enough to be legible to installation or repair personnel. At the manufacturing stage this can create delays and cost overruns because upon inspection the branded semiconductor chips must be returned for cleaning and rebranding. However, if the brands are not inspected, it can be a herculean task to replace a chip whose brand is not legible. Second, many brands, although at first legible, can fade or wear off with solvent attack or time. This can be a significant problem as these brands may pass inspection only to become a mystery to any installation or repair personnel. Thus, what is needed in this field is semiconductor chip packages having durable, legible brands.

Accordingly, there has been a constant search in this art for methods of branding semiconductor chip packages with legible, durable brands.

DISCLOSURE OF INVENTION

This disclosure is directed to a method of branding semiconductor chips that results in a legible, durable brand. The chip package is warmed to a temperature of about 95 degrees Farenheit (°F) to about 130° F. An inked brand is applied to the warmed chip package and the branded chip package is maintained at a temperature of at least about 80° F. until the temperature is raised to a temperature sufficient to cure the branded chip package. Then, the branded chip package is cured resulting in a brand having greater clarity and permanency.

This invention advances the field of branding semiconductor chip packages by providing critical branding process steps that result in legible, durable brands. Thus, it makes a significant advance in the semiconductor industry by providing branded chips that can be readily identified for installation or replacement purposes.

The foregoing and other objects, features and advantages will be apparent from the specification and claims from the accompanying drawings which will illustrate an embodiment of the invention.

BRIEF DESCRIPTION OF DRAWING

The Figure represents a perspective view of the offset branding process used in this disclosure.

BEST MODE FOR CARRYING OUT THE INVENTION

This semiconductor chip package branding method may be used to advantage on virtually any type of chip package material. Typically, polymeric, metallic or ceramic materials can be provided with a legible, durable brand by utilizing the process of this disclosure. These packaging materials include but are not limited to epoxy resins, novalacs, acrylics, metals such as aluminum, gold, silver, steel and ceramics. It is especially preferred to use this process to brand semiconductor chip packages that comprise at least two different materials bonded together, for example, in at least two layers. For example, dual-in-line (DIP) leadless chip carriers (LCC) chip packages, and pin grid packages comprise a ceramic substrate having a layer of gold (gold lid) bonded to this ceramic substrate. These ceramic-gold lid semiconductor chip packages result in especially difficult branding problems because of the different nature of the materials. As the chips go through the thermal cycling required by processing the different coefficients of thermal expansion of the two materials cause the gold lid to form a permanently bowed surface. This bowed surface is extremely difficult to brand with a constant, durable, legible label. However, the process of this invention works extremely well on even these uneven surfaces.

Generally any good quality ink that provides the clarity and durability described above may be used in the practice of this invention. It is preferred to use an epoxy ink as this provides clarity and brand durability, however phenolic inks may also be used. There are a variety of epoxy inks that are generally commercially available such as Markem 7904, 4405 and 7224 ink available from Markem Corporation (Keene, New Hampshire) that may be used. It is especially preferred to apply an ink using this process that will pass military specification brand permanency test (MIL-STD-883C Method No. 2015.4) which is hereby incorporated by reference. One especially preferred commercially available epoxy ink that passes this military specification is Markem 7224 ink.

Typically, the semiconductor chip packages are cleaned prior to branding although with this branding process it is less critical to have a virtually clean package than it is with most other branding methods. Generally any cleaning process may be used that results in a clean surface so that the brand can adhere in a legible, durable fashion. However, it is preferred to clean the semiconductor chip package in an alkaline solution whose temperature is about 145° F. (63° C.) to about 160° F. (72° C.) for about five minutes. The semiconductor chip package can then be rinsed in a deionized water cascade with an air bubbler for about three minutes followed by a two-minute cleaning and drying with isopropyl alcohol. An additional drying step in a hot air chamber at about 180° F. (83° C.) for about five minutes results in a dry surface. The final step is a one-minute degreasing in a Freon ® TMS solvent (Du Pont DeNemours E.I. Company, Wilmington, Delaware) vapor zone at about 100° F. (38° C.).

Following cleaning, it is preferred to warm the semiconductor chip package prior to branding as this aids in the transfer and adhesion of the ink. It is especially preferred to warm the semiconductor chip package to a temperature of about 95° F. (35° C.) to about 130° F. (55° C.). It is believed that if the heat is too high, too much ink will be transferred and the brand will be obscured. If the temperature is not high enough insufficient ink will be transferred to the package surface and the brand will be less durable and legible in nature. It is believed that this temperature relationship is the result of the effect of temperature on the viscosity of the ink. It is preferred to warm the packages to a temperature of about 110° F. (44° C.) to about 120° F. (49° C.) and especially preferred to warm the packages to a temperature of about 115° F. (47° C.) as this provides brands that consistently exhibit the properties described above. This temperature range is especially useful with epoxy inks. Although, any method of warming may be used that results in a chip package brand that is legible and durable, it is also necessary that the semiconductor chip itself is not affected by the warming method. Thus it is preferred to use a radiation form of heat and especially preferred to use conventional infrared heat. Electrical resistance heating can result in the generation of an electric magnetic field which can weaken the integrated circuits of the semiconductor chip. In similar fashion, a convection method of warming may result in the generation of charged particles in the air surrounding the chip and ultimately in an electrical static discharge that may damage the integrated circuits of the semiconductor chip.

Generally, any branding (printing) apparatus may be used in the practice of this invention that provides a brand having good clarity and durability. Branding apparatuses included direct and offset printing apparatuses. However, it is preferred to use an offset branding apparatus because it has a high thruput, easy setup and easy maintenance. One commercially available brander is the Automatic Marking Machine Model No. 5000ME available from Adcotech Corporation (Sunnyvale, California) although a direct printing apparatus may result in brands having a cleaner appearance. A clear understanding of the offset printing apparatus may be had by reference to the Figure described below.

The Figure details an offset printing apparatus which is part of the branding method of this disclosure. An ink roller 101 distributes a fine layer of ink over a brand bug 102. A brand bug is a commercial term for the desired stamp (or brand) whose image will be placed on the semiconductor chip package 105. An ink transfer pad 103 under the seat plate of paddle arm 104 kiss touches the brand bug 102, picks up the brand image (ink) from the brand bug, and transfers the ink of the brand to the surface of the semiconductor chip package 105 by touching the semiconductor chip package 105 surface with a uniform and instant contact pressure. The reliability of this process enables its automation which is in stark contrast to the manual machines required of conventional processes. In addition a contact time of about 0.2 second to about 1.0 second, preferably about 0.5 second results in a legible, durable brand unlike other processes which can require ten times that contact time. A contact time greater than 1.0 results in an obscured brand. A contact time less than 0.2 results in an uneven and blurry brand.

To insure brand clarity and brand durability after the ink is applied, it is critical to maintain the branded semiconductor chip package at a temperature at least above about 80° F. (27° C.) until the application is of sufficient energy to cure the ink on the branded chip package. This aids in assuring brand clarity because if the temperature is allowed to drop the brand can become blurry. It is believed that this results from the ink shrinking due to surface tension. It is preferred to maintain the branded semiconductor package chip at a temperature at least above about 85° F. (30° C.).

The branded chip package can be cured at a temperature and for a time sufficient to cure the brand onto the chip package resulting in a legible durable brand. Depending upon the ink used, the temperatures typically range from about 250° F. (122° C.) to about 350° F. (177° C.), preferably about 300° F. (149° C.) and the time periods can range from about 2 hours to about 5 minutes, preferably about 1 hour. The ink is sufficiently cured when it has the clarity and durability described above.

EXAMPLE

The chip packages were soaked in an alkaline solution of deionized water 3150 milliliters (mls) butyl Cellosolve solvent (Union Carbide Corporation, New York, N.Y.) 75 mls and monoethanolamine 75 mls for 5 minutes. They were then rinsed in a deionized water cascade for 1 minute. This process was repeated 3 times. The chips were then soaked in an isopropyl bath for 2 minutes followed by drying in a hot air 180° F. (83° C.) chamber for 5 minutes. The chips were then degreased in the vapor zone above a vapor degreaser's cold sump (Vapor Degreaser Model PSD, Branson Cleaning Equipment Co., Shelton, Connecticut) for 1 minute. The chips were then heated to about 115° F. (47° C.) over a period of 30 minutes by a infrared warmer. The chip packages were then branded within 1 minute of removal from the warming area using an Automatic Marking Machine Model No. 5000ME as described above. Subsequent to branding the chip packages were maintained at about 85° F. (30° C.) until placed in a curing oven for 1 hour at 300° F. (149° C.). The packages were then removed and allowed to cool. The brand had good clarity and permanency as prescribed by MIL-STD-883C test.

This branding method can be used to print a variety of semiconductor chip pakages. These chip packages include conventional packages, LCC, DIP, pin grid packages and backup battery containing semiconductor chip packages. They can be used in a variety of applications including commercial as well as military and NASA applications. However, this branding method is particularly adapted to military and NASA applications where the specifications for brand clarity and permanency are extremely stringent.

This branding method provides the semiconductor industry with chip packages having durable labels. At initial installation or repair a package can be readily identified as its brand has good clarity and permanency. This method allows branding on a variety of surfaces including polymeric, metallic, ceramic, smooth/matte finish, and concave or convex surfaces. On each of these surfaces, a legible, permanent label can be quickly affixed to a semiconductor chip package enabling the ready identification of an individual chip. In addition, the reliability of this process enables the automation of branding chip packages. Thus, this invention facilitates the manufacture, installation and repair of electronic components.

It should be understood that the invention is not limited to the particular embodiment shown and described herein, but that various changes and modifications may be made without departing from the spirit or scope of this concept as defined by the following claims.

I claim:

1. A method for branding a semiconductor chip package comprising:

a. warming the chip package to a temperature of about 95° F. (35° C.) to about 130° F. (55° C.);

b. applying an inked brand to the warmed chip package resulting in a branded chip package;

c. maintaining the branded chip package at a temperature of at least about 80° F. (27° C.) until raising the temperature to a temperature sufficient to cure the ink on the branded chip package; and d. curing the ink on the branded chip package resulting in a brand having greater clarity and permanency.

2. The method as recited in claim 1 wherein the chip package is cleaned prior to warming.

3. The method as recited in claim 1 wherein the chip package is warmed by radiation.

4. The method as recited in claim 1 wherein the chip package comprises a layer of gold bonded to a layer of ceramic.

5. The method as recited in claim 1 wherein the inked brand comprises an epoxy ink.

6. The method of claim 1, wherein said warming step (a) is conducted at a temperature of from about 110 to about 120 degrees Fahrenheit.

7. The method of claim 1 wherein said inking step (b) is conducted by ink transfer contact at a contact time of from about 0.2 to about 1.0 seconds.

8. The method of claim 1 wherein said curing step (d) is conducted at a temperature of from about 250 to about 350 degrees Fahrenheit.

9. The method of claim 1 wherein said curing step (d) is conducted at a time of from about 5 minutes to about 2 hours.

10. The method of claim 9 wherein said curing step (d) is conducted at a time of about 1 hour.

* * * * *